United States Patent [19]

Chang et al.

[11] Patent Number: 4,985,201

[45] Date of Patent: Jan. 15, 1991

[54] GENERATOR ROTOR STEELS

[75] Inventors: Keh-Minn Chang, Schenectady; Ioannis P. Vasatis, Clifton Park, both of N.Y.

[73] Assignee: General Electric Company, Schenectady, N.Y.

[21] Appl. No.: 451,914

[22] Filed: Dec. 18, 1989

[51] Int. Cl.[5] ..... C22C 38/44; C22C 38/46

[52] U.S. Cl. ..... 420/109; 420/110; 148/335

[58] Field of Search ..... 420/109, 110; 148/335

[56] References Cited

U.S. PATENT DOCUMENTS

| | | | |
|---|---|---|---|
| 2,992,148 | 4/1959 | Yeo et al. | 420/104 |
| 3,954,454 | 4/1975 | Shaw | 420/104 |
| 4,820,486 | 4/1989 | Shimogori et al. | 420/109 |

FOREIGN PATENT DOCUMENTS

| | | | |
|---|---|---|---|
| 47-47487 | 11/1972 | Japan | 420/109 |

OTHER PUBLICATIONS

"Significant Progress in the Development of Large Turbine and Generator Rotors," Boyle, C. J., Curran, R. M. Deforest, D. R., Newhouse, D. L. Proceedings, American Society for Testing and Materials, vol. 62, pp. 1156–1175, 1962.

"Further Progress in the Development of Large Steam Turbine and Generator Rotors," Boyle, C. J., Curran, R. M., Deforest, D. R., Newhouse, D. L. Proceedings, General Electric Corp., 1965.

"Long Term Isothermal Embrittlement in 3.5Ni, 1.75Cr, 0.50Mo, 0.20C Steel," Gould, G. C., Temper Embrittlement in Steel, ASTM Technical Publication 407, pp. 90–105, 1967.

"Temper Embrittlement of Rotor Steels," Newhouse, D. L., Holtz, H. G., Temper Embrittlement in Steel, ASTM Technical Publication 407, pp. 106–126, 1967.

"Standard Specification for Vacuum-Treated Steel Forgings for Generator Rotors," A469, Annual Book of ASTM Standards, pp. 299–302, vol. 105, 1989.

*Primary Examiner*—Deborah Yee

*Attorney, Agent, or Firm*—James E. McGinness; James C. Davis, Jr.; James Magee, Jr.

[57] ABSTRACT

A low-alloy steel suitable for use in generator rotors and having a combination of good strength and impact energy with a high magnetic permeability is disclosed. The low-alloy steels are comprised of in weight percent; about 3.5 to 5.25 percent nickel, about 0.75 to 2.0, percent chromium, about 0.3 to 0.8 percent molybdenum, about 0.05 to 0.15 percent vanadium, about 0.1 to 0.28 percent carbon, about 0.03 to 0.1 percent niobium or titanium, and the balance substantially iron, wherein nickel, chromium, and carbon additions are balanced.

8 Claims, 5 Drawing Sheets

GENERATOR ROTOR STEELS

BACKGROUND OF THE INVENTION

The present invention relates to alloy steels and, more particularly, to low-alloy steels characterized by having a combination of high strength, high impact energy and a high magnetic permeability.

The following background and description of the invention is benefitted by reference to the figures in which:

FIG. 1 compares the magnetic permeability of commercial low-alloy generator rotor steels having minimum yield strengths of 80 and 90 ksi.

FIG. 2 compares the magnetic permeability of commercial low-alloy generator rotor steels to the low-alloy steels of this invention.

Figure 1:
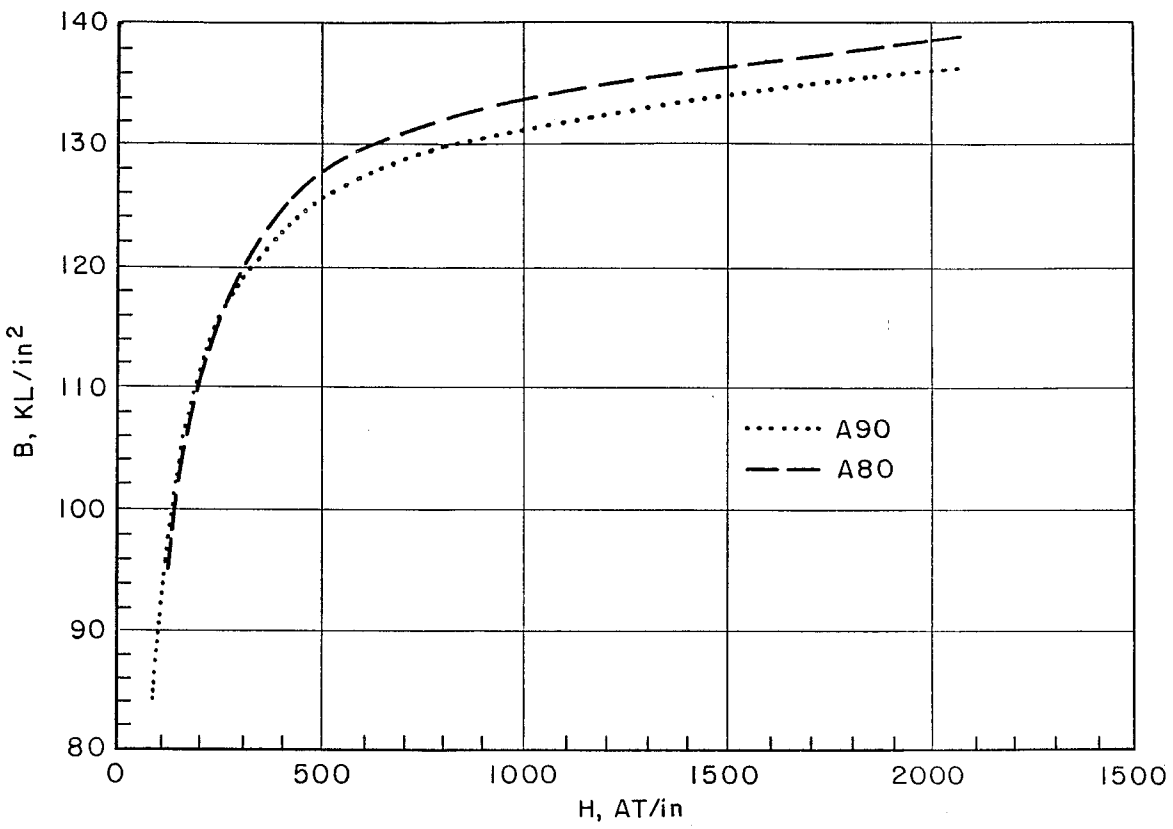

Generator rotor forgings play a vital role in the design of large generators and compact high-performance generators. As a result there have been many developments in a class of low-alloy steels that provide specialized properties required in generator rotor forgings. In particular, advanced generators designed to provide a high power density require rotors that exhibit a high magnetic permeability.

Generator rotors are enclosed by coil windings. When the rotor is operating current flowing in the coil windings magnetizes the core forming a closed magnetic circuit. Magnetic lines of force generated by the current flowing in the windings are called magnetic flux. The total magnetic flux in a core, divided by the cross-sectional area of the core gives the flux density, B. Magnetizing force, H, is the force which tends to produce a magnetic field per unit of core length. Permeability is a measure of the ease with which magnetic lines of force can pass through a substance magnetized with a given magnetizing force. Permeability is expressed as the ratio between the magnetic flux density, B, produced by the magnetizing force, H. A generator rotor can produce more current if the rotors magnetic permeability is increased.

During the 1950's and 60's extensive research concerning the failure of several generator rotor forgings identified as the important mechanical properties required in generator rotors: a low fracture appearance transition temperature, high impact energy , tensile ductility, and high strength; Boyle, et al. "Significant Progress in the Development of Large Turbine and Generator Rotors", American Society for Testing and Materials Proceedings, Vol. 62, 1962, pp. 1156 to 1175.

The fracture appearance transition temperature is the temperature at which an impact test displays a percentage, usually 50 percent, of a ductile versus a brittle fracture appearance on the fractured surface of an impact test. In impact testing, loading is applied rapidly to a notched test specimen so that the material must absorb energy rather than resist a force as in tension testing. Impact energy is a measure of resistance to shock loading measured in foot-pounds and is sometimes herein referred to as toughness. The impact testing and test specimens referred to herein are Charpy V-notch tests, ASTM E23-88 "Notched Bar Impact Testing of Metallic Materials," American Society for Testing and Materials, Vol. 3.01, pp. 198–218.

A low fracture appearance transition temperature and high impact energy are desirable because many alloy steels are susceptible to brittle fracture, and that brittle failure is related to temperature, particularly to temperature decrease in the case of ferritic steels such as the low-alloy steels discussed herein. As temperature decreases, a temperature range is reached, often referred to in the art as the "transition zone", wherein the alloy steel is passing from a state of toughness into a state of brittleness. In other words, a lower impact energy is required to propagate a crack through the steel. As temperature is further decreased, embrittlement of the steel is inevitable. Accordingly, alloy steels characterized by a low fracture appearance transition temperature are the most suitable in resisting brittle failure. Generally when comparing alloy steels, the alloys having a higher room temperature impact energy will have a lower fracture appearance transition temperature.

U.S. Pat. No. 2,992,148, to Yeo et al., discloses low-alloy steels suitable for generator rotors containing about 5 to 5.5 percent nickel, about 0.2 to 0.5 percent molybdenum, about 0.04 to 0.3 percent vanadium, and up to about 0.5 percent chromium, the sum of molybdenum plus chromium being not more than 0.75 percent. By analyzing a series of alloys in the '148 patent it was shown that molybdenum or chromium additions have the effect of increasing the strength of the alloys, but impact energy and magnetic properties were adversely reduced. According to the teaching of Yeo et al. in the '148 patent; where a combination of good strength, good impact properties and high magnetic properties is essential, e.g., rotor shafts, the chromium and molybdenum content should be kept low, i.e., not more than 0.5%. In addition, the combined molybdenum and chromium contents should not exceed 0.75 percent.

Figure 2:
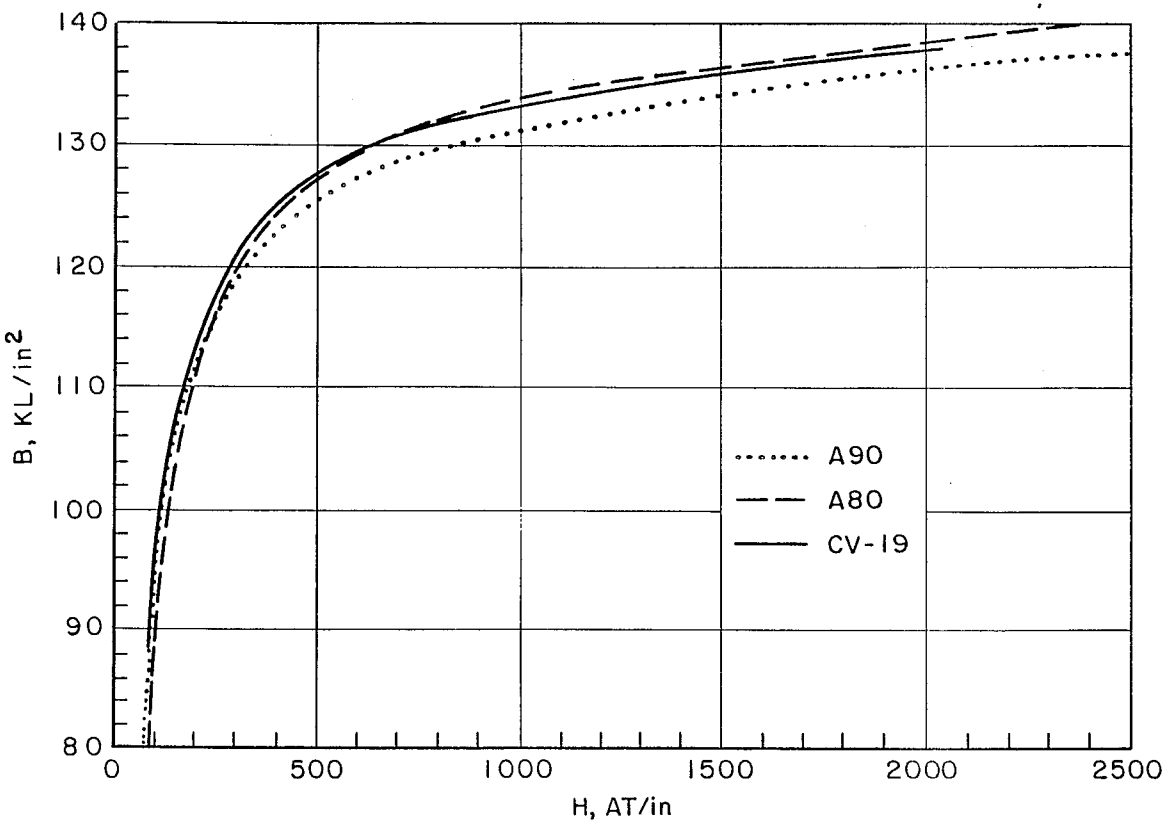

A commercial low-alloy steel that provides an 80 ksi minimum yield strength, herein referred to as low-chromium Ni-Cr-Mo-V steel and identified as A80 in FIGS. 1 and 2, is comprised of about 3.5 to 4.0 weight percent nickel, about 0.70 to 1.0 weight percent chromium, about 0.30 to 0.45 weight percent molybdenum, and about 0.09 to 0.15 weight percent vanadium. The term ksi stands for Kips per square inch which is a unit of stress representing 1000 pounds per square inch. Another commercial alloy developed to provide a 90 ksi minimum yield strength, herein referred to as high-chromium Ni-Cr-Mo-V steel and identified as A90 in FIGS. 1 and 2, has a slightly lower nickel content of 3.25 to 4.0 weight percent and about a 1 weight percent higher chromium content of 1.5 to 2.0 weight percent. Similar low-alloy steels are disclosed in ASTM A469 "Standard Specification for Vacuum Treated Steel Forgings for Generator Rotors." Consistent with the teachings of the '148 patent, the increased chromium content of the high-chromium Ni-Cr-Mo-V steels improves the yield strength; however, magnetic permeability is reduced in the high-chromium Ni-Cr-Mo-V steel. The reduced magnetic permeability of the high-chromium Ni-Cr-Mo-V steel as compared to the low-chromium Ni-Cr-Mo-V steel is shown in FIG. 1.

FIG. 1 is a graph showing the magnetization curves for low-chromium and high-chromium Ni-Cr-Mo-V steels. On the ordinate is plotted the flux density, B in kilolines per square inch, produced by a magnetizing force, H in ampere-turns per inch, plotted on the abscissa. Because permeability is the ratio of flux density to magnetizing force, alloys having a higher flux density for a given magnetizing force have a higher permeability. In FIG. 1, A80 is the low-chromium Ni-Cr-Mo-V steel and is shown to have a higher magnetic permeability than the high-chromium Ni-Cr-Mo-V steel, A90.

Steel alloys containing nickel, chromium, molybdenum and vanadium having up to 90 and 100 ksi minimum yield strengths are known. However, magnetic permeability has been reduced in these higher strength alloys as compared to alloys that provide an 80 ksi minimum yield strength. The ASTM A469 alloys, the commercial low and high-chromium Ni-Cr-Mo-V steels, and the alloys disclosed in the '148 patent are sometimes herein generally referred to as the low-alloy Ni-Cr-Mo-V steels.

Temper embrittlement has been a long standing metallurgical problem with the heat-treatment of low-alloy steels. Embrittlement is observed after exposure of a susceptible steel to the temperature range 700° to 1050° F. The exposure may be isothermal or not, with embrittlement observed in either case. The principal effect of temper embrittlement is to cause an increase in the fracture appearance transition temperature. Because low-alloy steels are normally heat treated above the temper embrittling temperature range, temper embrittlement can be minimized by quickly cooling a low-alloy steel through the 700° to 1050° F. temper embrittling range.

Unfortunately, early experience with the low-alloy Ni-Cr-Mo-V steels showed a susceptibility of these steels to temper embrittlement. In general, generator rotors are massive forgings being 30, 40, or even 60 inches or above in diameter. The massive size of these forgings makes it impossible, as a practical matter, to quickly quench the forging through the temper embrittling temperature range. Therefore, in the production of rotor shafts, it would be advantageous to employ alloy steels which are not susceptible to temper embrittlement, because of the varied cooling that such massive bodies experience during necessary heat treatment.

New generator designs require an increase in the size or operating speed of turbine generator rotors. As a result a combination of strength and toughness is required that exceeds the strength and toughness of the low-alloy Ni-Cr-Mo-V steels described above. Therefore, it is an object of this invention to provide low-alloy steels that have an improved combination of yield strength and impact energy, with a magnetic permeability at least comparable to prior low-alloy Ni-Cr-Mo-V steels.

Another object of the present invention is to provide low-alloy steels having a comparable magnetic permeability to prior low-alloy Ni-Cr-Mo-V steels, while being capable of achieving a 120 ksi. minimum yield strength in combination with good impact energy.

Another object of the present invention is to provide low-alloy steels having improved magnetic permeability at yield strengths of 90 ksi or greater as compared to prior low-alloy Ni-Cr-Mo-V steels.

Another object of the present invention is to provide low-alloy steels having an improved combination of magnetic permeability, strength and toughness that cannot be achieved in prior low-alloy Ni-Cr-Mo-V steels.

Another object of this invention is to provide low-alloy steels that are relatively insensitive to temper embrittlement over a wide range of cooling rates and section sizes, but still manifest a desired combination of metallurgical properties including those referred to hereinbefore.

BRIEF DESCRIPTION OF THE INVENTION

Low-alloy steels disclosed herein are suitable for use in the manufacture of generator rotors due to the high magnetic permeability, high yield strength, and good toughness of the alloys. Surprisingly, We have found a high chromium content can be used when nickel and carbon are properly balanced with the chromium to provide low-alloy steels having an improved combination of strength, impact energy, and magnetic permeability over prior low-alloy Ni-Cr-Mo-V steels. The low-alloy steels of this invention contain critical ranges of nickel, chromium, carbon, and niobium or titanium wherein nickel is balanced with chromium and chromium is balanced with carbon.

The resulting low-alloy steels provide a combined improvement in strength and toughness over prior low-alloy Ni-Cr-Mo-V steels while maintaining a magnetic permeability at least comparable to low-alloy Ni-Cr-Mo-V steels as shown in FIG. 2. FIG. 2 is a graphical presentation of magnetization curves as explained above for FIG. 1, but additionally contains the magnetization curve for alloy CV19 of this invention.

Figure 4:
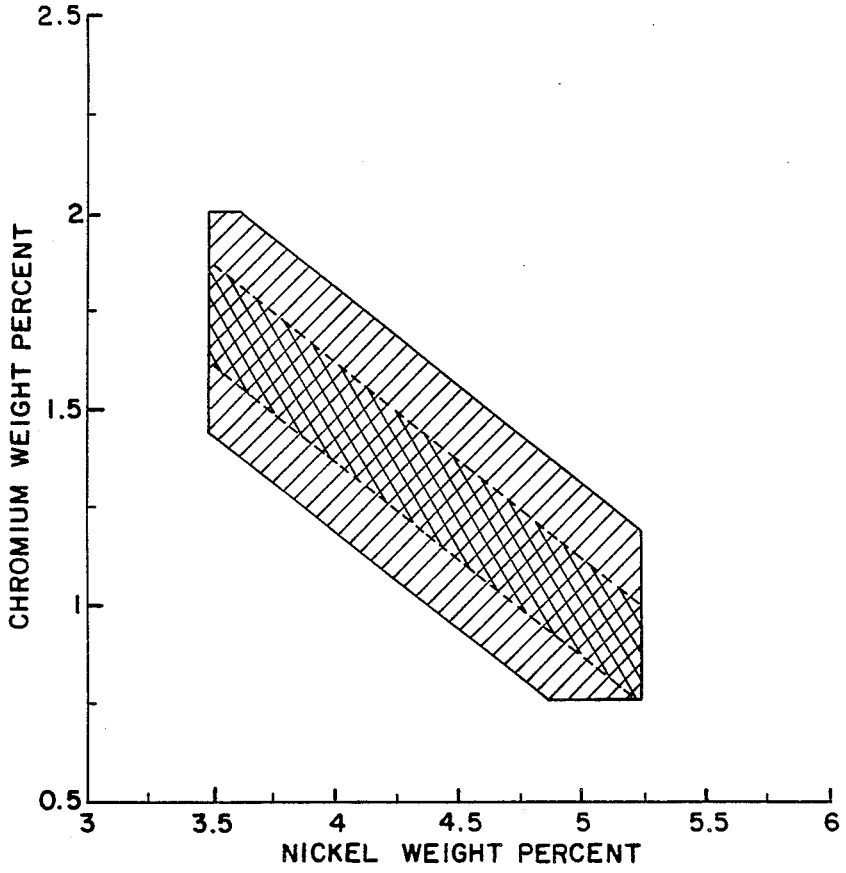
FIG. 4 is a graph showing the relationship between chromium and nickel content in the low-alloy steels of this invention.
Figure 5:
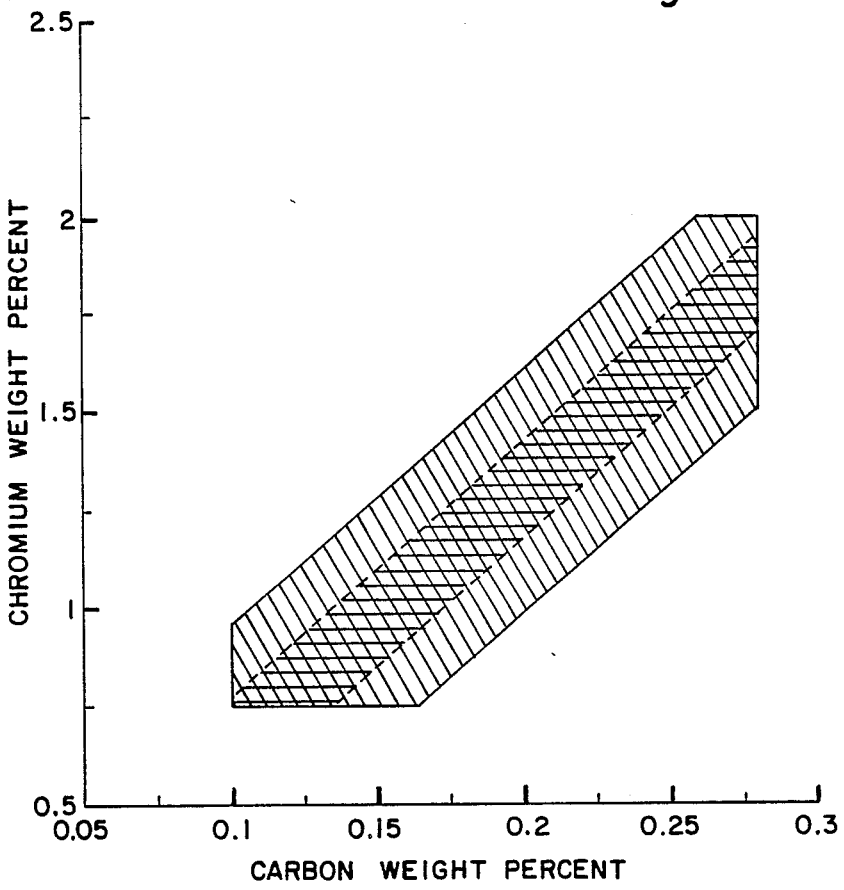
FIG. 5 is a graph showing the relationship between carbon and chromium content in the low-alloy steels of this invention.

The improved low-alloy steels are comprised of:

| Elements | Weight Percent |
|---|---|
| Nickel | 3.5–5.25 |
| Chromium | 0.75–2.0 |
| Molybdenum | 0.3–0.8 |
| Vanadium | 0.05–0.15 |
| Carbon | 0.1–0.28 |
| Niobium or Titanium | 0.03–0.1 |
| Iron | Balance |

wherein nickel and chromium are within the hatched area of FIG. 4 and chromium and carbon are within the hatched area of FIG. 5. Preferably nickel and chromium are within the cross-hatched area of FIG. 4, and chromium and carbon are within the cross-hatched area of FIG. 5.

As used herein, the phrase "balance substantially iron" means that iron is the predominant element being greater in content than any other element; however, other elements normally present as the result of melting low-alloy steels and that do not interfere with achievement of the yield strength, impact energy, and magnetic properties of the alloy may be present as minor impurities or up to non-interfering levels. For example, manganese can be present up to 0.03 weight percent, phosphorus up to 0.015 weight percent, sulphur up to 0.015 weight percent, and silicon up to 0.1 weight percent.

The term "high magnetic permeability" means a magnetic permeability higher than the magnetic permeability of low-chromium and high-chromium Ni-Cr-Mo-V steels.

The term "improved combination of yield strength and impact energy" means the combination of yield strength and impact energy is higher than the combination of yield strength and impact energy attainable with prior low-alloy Ni-Cr-Mo-V steels.

DETAILED DESCRIPTION OF THE INVENTION

It is important to understand that the present invention provides improvement in a combination of properties that are unattainable with prior low-alloy Ni-Cr-Mo-V steels. In prior low-alloy Ni-Cr-Mo-V steels, chromium is increased to provide higher strength and toughness, but magnetic properties are adversely reduced, as shown in FIG. 1. Further, when high-chromium Ni-Cr-Mo-V steels are heat treated to improve strength and toughness, magnetic properties are still further reduced. Therefore, in the prior low-alloy Ni-Cr-Mo-V steels, magnetic permeability was optimized in low-chromium Ni-Cr-Mo-V steels while strength and toughness were optimized in high-chromium Ni-Cr-Mo-V steels.

In the alloys of this invention, a combination of strength and toughness is achieved that is superior to the strength and toughness attainable in the prior low-alloy Ni-Cr-Mo-V steels, and more specifically superior to the combination of strength and toughness attainable in the high-chromium Ni-Cr-Mo-V steels. Surprisingly, the improved strength and toughness of the alloys of this invention is not accompanied by a reduced magnetic permeability, instead, the magnetic permeability of the alloys of this invention is improved over the magnetic permeability of low-chromium and high-chromium Ni-Cr-Mo-V steels.

Heat-treating massive components, such as generator rotors, requires long soak times at each step of the thermal treatment to provide adequate heating of the components core portion. In addition the rate at which the component can be cooled after each heat-treatment step is limited by the cooling rate of the components core portion. In the core portion of a massive component such as a generator rotor, it has been estimated that the maximum cooling rate that can be achieved is about 1000° F./hr. It is well known within the art that strength, toughness, and magnetic properties of low-alloy Ni-Cr-Mo-V steels are greatly affected by such heat-treatment steps, and rates of cooling particularly from the austenitizing heat-treatment steps. Austentizing heat-treatments are heat-treatments above the temperature at which the low-temperature ferritic or bainitic microsture completely transforms to the austenite phase. For example, in the examples below austenitizing heat-treatments are above 1500° F.

Generator rotors made from the alloys of this invention can be processed according to standard electric furnace melting, vacuum-degassing, forging, and heat-treatment by austenitizing, water quenching, and tempering used in the manufacture of commercial generator rotor forgings. Tempering is the final, low temperature stress relief anneal. For example, in the examples below tempering is performed between about 1050° to 1150° F.

The strength, toughness, and magnetic properties that can be achieved in a low-alloy Ni-Ci-Mo-V steel after long term heat treatments and limited cooling rates practically limit the application of the alloy in various generator rotor designs requiring minimum yield strengths, impact energies, and magnetic properties. In the Examples below, samples prepared from the alloys of this invention are subjected to long term heat-treatments and slow cooling rates to show the combination of properties that can be achieved with such heat-treatments and cooling rates. Samples prepared from low-alloy Ni-Cr-Mo-V steels are also subjected to long term heat treatments and slow cooling rates to show the combination of properties that can be achieved.

EXAMPLE 1

Low-chromium and high-chromium Ni-Cr-Mo-V steels were prepared according to the compositions shown below in Table I. Large components were prepared from each of the compositions in Table I according to well known commercial processing steps for generator rotor forgings; including electric furnace melting, casting by vacuum-stream-degassing, and forging. Samples were taken from the large components for testing. A variety of heat-treatments followed by slow cooling, shown in Table II below, were performed on the samples to show the interaction between strength, toughness, and magnetic properties caused by such heat-treatments. In Tables I and II the alloys designated as A80 and A90 are the low-chromium and high-chromium Ni-Cr-Mo-V steels that provide 80 ksi. and 90 ksi. minimum yield strengths respectively.

TABLE I

| | Chemical Composition in Weight Percent | |
|---|---|---|
| | Low-Chromium A80 | High-Chromium A90 |
| Nickel | 3.5–4.0 | 3.25–3.75 |
| Chromium | 0.70–1.00 | 1.5–2.0 |
| Molybdenum | 0.30–0.45 | 0.25–0.45 |
| Vanadium | 0.09–0.15 | 0.09–0.15 |
| Manganese max. | 0.40 | 0.4 |
| Carbon max. | 0.28 | 0.28 |
| Iron | Balance | Balance |

Tensile tests were prepared from the samples and tested at room temperature on an Instron tensile testing machine in conformance with ASTM E8 "Standard Test Methods of Tension Testing of Metallic Materials" American Society for Testing and Materials, Vol. 3.01, pp. 131–146, 1989. The yield strength was determined by the 0.2% offset technique. Yield strengths from the specimens prepared as described above are shown in Table II below.

Charpy-V notch impact tests were prepared from the samples and tested at room temperature according to the ASTM E23 standard referenced above. The measured Charpy impact energy is recorded in Table II below.

The magnetic properties of the samples prepared in Examples 1, and 2 below, were characterized by measuring the flux density of a cylindrical specimen in a known magnetic field. The cylindrical specimens had a diameter of 0.275 inch, a length of 1.38 inches, and were inserted into a slightly larger DC electromagnetic coil. A controlled current was applied to the coil to produce a desired magnetic field. The coils magnetic field, measured by a Bell gaussmeter, produced a flux density in the specimen inside the coil. The flux density in the specimen was measured on a Walker integrating fluxmeter. The magnetic field strength was varied and the resulting flux density was recorded until 45 data points were obtained for each of the specimens.

A complete B-H curve, herein referred to as a magnetization curve, can be prepared from the data points. The A80 and A90 magnetization curves shown in FIGS. 1 and 2 were obtained from samples heat treated at; 1650° F. for 2 hours and furnace cooled, 1550° F. for 4 hours and furnace cooled, and 1150° F. for 4 hours and cooled in flowing argon. The magnetization curve shown in FIG. 2 for CV19 was obtained from the sample heat treated as shown in Table IV for CV19 test sample no. 2.

Two additional magnetic properties can be derived from the magnetization curves; saturation flux density, and excitation field strength. A magnetic material has a component of flux density that is due to the alignment of magnetic domains within the material. An intrinsic property of every magnetic material is found when the magnetic domains are completely aligned within the material, this property is herein referred to as the saturation flux density, $B_s$. The magnetic force needed to excite the material to obtain the saturation flux density is herein referred to as the excitation field strength $H_e$.

Figure 3:
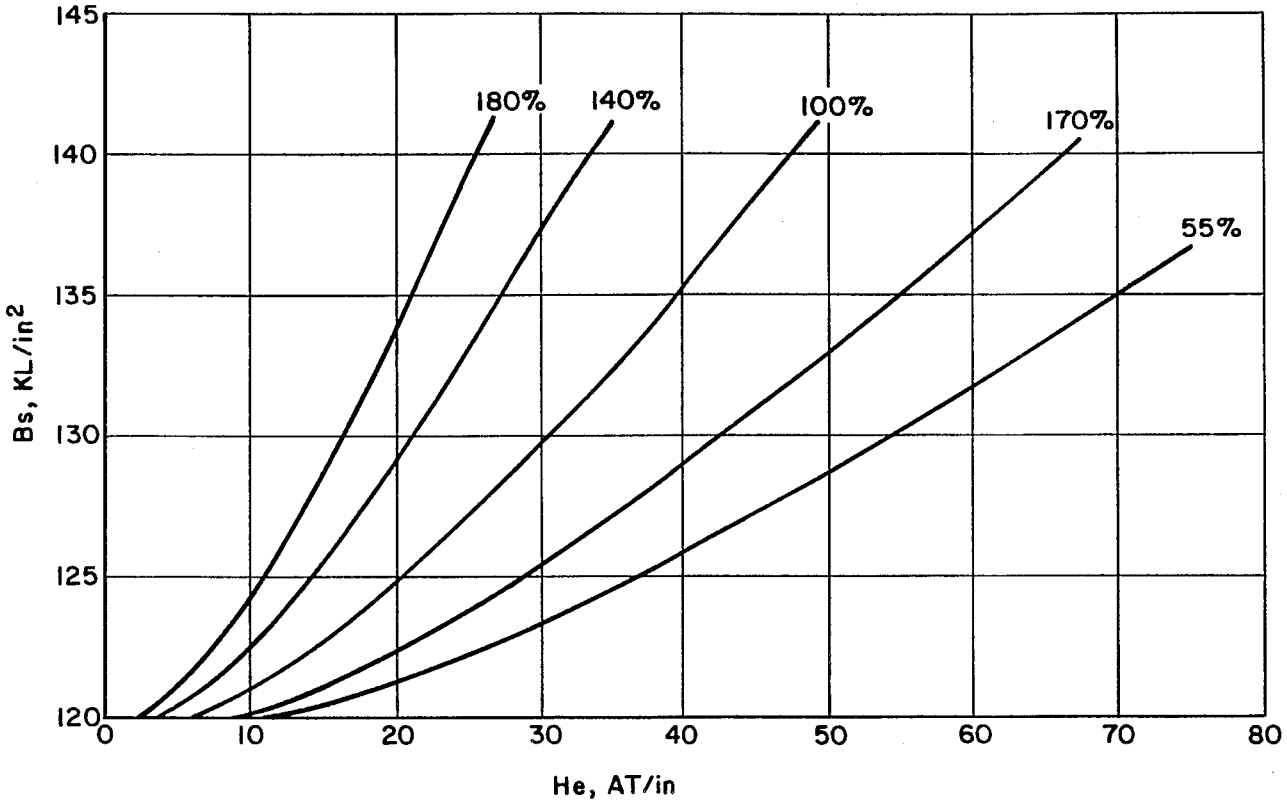
FIG. 3 is a graph showing the magnetic properties that are needed in a generator rotor to obtain given percentages of the magnetic performance in a current generator design.

The saturation flux density and excitation field strength are determined by applying the magnetic data measured from each specimen in the equation, $$B-\mu_o H=B_s/(1+H_e/H),$$

where $\mu_o$ is the permeability of air, 3.192. The equation is solved by linear regression analysis techniques for $H_e$ and $B_s$. The $B_s$ and $H_e$ are shown for each of the samples in Tables II and IV where magnetization curves were measured. For generator rotor alloys it is desirable to have a high $B_s$ and a low $H_e$, although steel alloys having a high $B_s$ will generally have a higher associated $H_e$. To aid in the relative comparison of $B_s$ and $H_e$ values in Tables II and IV, FIG. 3 is provided. FIG. 3 is a graph showing the $B_s$ and $H_e$ requirements for different generator performance levels. The percentage curves in FIG. 3 show the $B_s$ and $H_e$ required in a rotor alloy to operate a generator at 55, 70, 100, or 140 percent of the magnetic performance for a current generator design.

TABLE II

| Alloy | Test No. | Yield Strength (ksi) | Impact Energy (f + − lbs) | $B_s$ KL/in$^2$ | $H_e$ AT/in. | Heat Treatment (°F.) |
|---|---|---|---|---|---|---|
| | | | Mechanical Properties of Samples From Compositions in Table I | | | |
| A80 | 1 | 137 | 37 | 133.55 | 38.65 | 1550°/4 hr/FC |
| | 2 | 134.6 | 32 | 135.98 | 45.33 | 1550°/4 hr/FC + 1150°/1 hr |
| | 3 | 104.1 | 80 | 133.50 | 37.71 | 1550°/4 hr/FC + 1150°/64 hr |
| | 4 | 147.2 | 35 | 136.60 | 47.25 | 1550°/4 hr/FC + 1050°/2 hr |
| | 5 | 116.8 | 32 | 134.75 | 35.70 | 1550°/4 hr/FC + 1050°/32 hr |
| A90 | 1 | 148 | 36 | 120.1 | 131.37 | 1550°/4 hr/FC |
| | 2 | 127.3 | 68 | 128.8 | 52.19 | 1550°/4 hr/FC + 1150°/1 hr |
| | 3 | 99.7 | 127 | 131.87 | 34.25 | 1550°/4 hr/FC + 1150°/64 hr |
| | 4 | 169.3 | 38 | 131.77 | 51.77 | 1550°/4 hr/FC + 1050°/2 hr |
| | 5 | 130.3 | 92 | 127.1 | 35.74 | 1550°/4 hr/FC + 1050°/128 hr |

FC - furnace cool 100° F./hour

EXAMPLE 2

Test samples were prepared from the alloys shown below in Table III. Alloys CV18, CV19, and CV20 in Table III are within the composition ranges claimed for some of the alloys of this invention.

TABLE III

| Alloy | Ni | Cr | Mo | V | Mn | C | Nb | Ti | Fe |
|---|---|---|---|---|---|---|---|---|---|
| | | | | Chemical Composition of Low-Alloy Steels | | | | | |
| CV-4 | 3.75 | 0.85 | 0.40 | 0.12 | 0.3 | 0.25 | 0.05 | | Bal. |
| CV-12 | 3.75 | 0.85 | 0.40 | 0.12 | 0.30 | 0.25 | | 0.10 | Bal. |
| CV-14* | 3.75 | 0.85 | 0.40 | 0.12 | 0.30 | 0.25 | | 0.10 | Bal. |
| CV-17** | 3.75 | 0.85 | 0.40 | 0.12 | 0.30 | 0.25 | 0.05 | | Bal. |
| CV-18 | 3.75 | 1.75 | 0.50 | 0.1 | 0.25 | 0.25 | 0.05 | | Bal. |
| CV-19 | 4.25 | 1.25 | 0.50 | 0.1 | 0.25 | 0.20 | 0.05 | | Bal. |
| CV-20 | 5.0 | 1.0 | 0.5 | 0.1 | 0.25 | 0.15 | 0.05 | | Bal. |

*also contains 0.015 N
**also contains 0.005 Al

Melts of the compositions in Table III were prepared by vacuum-induction melting using laboratory purity raw materials. A 7.5 pound melt was made for each composition, and was cast into a 2 ⅛ inch diameter by 5 ¼ inch high chilled copper mold with a 2 inch high hot top. The ingot was heated to about 2192° F. for 24 hours in argon, and forged at about 2000° F. into plates of about 1.5 inch by 2.5 inch by 5.5 inch employing a hydraulic hammer. The forgings were hot rolled at about 1650° F. to produce about a 1 inch thick plate. Samples were secured from the plate along the longitudinal direction and tested in compliance with the ASTM tensile and impact testing standards referenced above. To simulate the thermal processing of a heat treated rotor at the center portion of the rotor, the samples were given lengthy heat treatments and slow cooled in a furnace or in a sealed ceramic tube after the austenitizing heat-treatments as shown in Table IV below.

TABLE IV

| Alloy | Test No. | Yield Strength (ksi) | Impact Energy (f + − lbs) | $B_s$ KL/in$^2$ | $H_e$ AT/in. | Heat Treatment (°F.) |
|---|---|---|---|---|---|---|
| | | | Mechanical Properties of Samples From Experimental Heats in Table III | | | |
| CV4 | 1 | 129.4 | | 134.2 | 30.7 | 1652°/2 hr/FC + 1553°/4 hr/FC + 1148°/4 hr/CC |
| CV12 | 1 | 117.9 | 31 | | | 1652°/12 hr/FC + 1553°/12 hr/FC + 1112°/24 hr/FC |

TABLE IV-continued

| Alloy | Test No. | Yield Strength (ksi) | Impact Energy (f + − lbs) | $B_s$ KL/in$^2$ | $H_e$ AT/in. | Heat Treatment (°F.) |
|---|---|---|---|---|---|---|
| | | | Mechanical Properties of Samples From Experimental Heats in Table III | | | |
| CV14 | 1 | 108.8 | 56 | 133.9 | 33.5 | 1652°/12 hr/FC + 1553°/12 hr/FC + 1148°/24 hr/CC |
| CV17 | 1 | 111.9 | 76 | 133.5 | 34.5 | 1652°/12 hr/FC + 1553°/12 hr/FC + 1148°/24 hr/CC |
| CV18 | 1 | 104.2 | 133 | 127.12 | 28.58 | 1652°/12 hr/FC + 1517°/12 hr/FC + 1148°/24 hr/AC |
| | 2 | 123.1 | 145 | 131.79 | 30.70 | 1742°/12 hr/FC + 1553°/12 hr/BRK 1049°/24 hr/AC |
| CV19 | 1 | 111.4 | 145 | 128.76 | 34.74 | 1652°/12 hr/FC + 1517°/12 hr/FC+ 1148°/24 hr/AC |
| | 2 | 122 | 152 | 133.52 | 29.8 | 1742°/12 hr/FC + 1553°/12 hr/BRK 1094°/24 hr/AC |
| | 3 | 147 | 148 | 134.83 | 37.60 | 1742°/12 hr/FC + 1553°/12 hr/BRK 1049°/24 hr/AC |
| CV20 | | 112.3 | 136 | 129.70 | 32.50 | 1652°/12 hr/FC + 1517°/12 hr/FC + 1148°/24 hr/AC |

FC - furnace cool 100° F./hour
Ac - air cool 5000 ° F./hour
BRK - ceramic tube cooling 1000° F./hour
CC - flowing argon cooling 5000° F./hour With reference to the test results shown in Table II, it can be seen that the high-chromium Ni-Cr-Mo-V steels generally provide a higher yield strength and impact energy over the low-chromium Ni-Cr-Mo-V steels. However, the low-chromium Ni-Cr-Mo-V steels generally provide better magnetic properties as shown by the higher saturation flux density, $B_s$, and lower excitation field strength, $H_e$,. The tradeoff between magnetic properties and strength for the low-chromium and high-chromium Ni-Cr-Mo-V steels was expected as discussed above. Comparison is next made of the properties of low-chromium and high-chromium Ni-Cr-Mo-V steels shown in Table II, with the magnetic property design requirements for current generators shown in FIG. 3.

In comparing the $B_s$ and $H_e$ values in Table II, with the design requirements shown in FIG. 3 it is apparent the test samples having heat-treatments that provide the best magnetic properties also provide lower yield strengths. For example, alloy A90 test no. 3 provides the best magnetic properties in the high-chromium Ni-Cr-Mo-V steel tests, having a $B_s$ of 131.87 and $H_e$ of 34.25. However test no. 3 also exhibits the lowest yield strength in the high-chromium Ni-Cr-Mo-V steel tests at 99.7 ksi.

Conversely, test samples in Table II that were heat-treated to provide higher yield strengths, as are required in new high performance generator applications, have reduced magnetic properties that are considerably below the criteria shown in FIG. 3 for current generator designs. For example, alloy A90 test no. 4 has the highest yield strength of the high-chromium Ni-Cr-Mo-V steel tests at 169.3 ksi. However a generator rotor made from alloy A90 that is heat-treated to have the strength of test no. 4 would operate at less than 70% of the performance of a current generator design due to the reduced $B_s$ and $H_e$ for that heat-treatment.

It is also significant to note that the test samples in Table II that have the heat-treatments producing the higher yield strengths have significantly reduced impact energy. Low-chromium and high-chromium Ni-Cr-Mo-V steels can be heat treated to achieve high yield strengths required in new generator designs of 120 ksi. or higher, however, impact energy and magnetic properties are adversely affected and an undesirable combination of properties for generator rotor applications is the result.

The alloys in Table III and test results in Table IV are representative of the alloys of this invention. In Table III it can be seen that alloys CV4,CV12, CV14, and CV17 contain nickel chromium molybdenum and vanadium contents similar to the low-chromium Ni-Cr-Mo-V steels, but additionally contain niobium or titanium. In Table IV it is shown that alloys CV4, CV12, CV14 and CV17 provide a combination of yield strength, impact energy and magnetic properties that are slightly improved over the low-chromium and high-chromium Ni-Cr-Mo-V steels.

Referring to Table III, alloys CV18, CV19 and CV20 contain a niobium addition, but also contain critical ranges of nickel, chromium, molybdenum, and carbon wherein the nickel and chromium are within the cross-hatched area of FIG. 4, and chromium and carbon are within the cross-hatched area of FIG. 5. In Table IV it can be seen that alloys CV18, CV19 and CV20 provide a superior combination of yield strength and impact energy, with magnetic properties that are at least comparable to the low-chromium and high-chromium Ni-Cr-Mo-V steels. The magnetization curves of alloys A80, A90 and CV19 are compared in FIG. 2 where alloy CV19 is shown to have magnetic properties comparable to the low-chromium and high-chromium Ni-Cr-Mo-V steels A80 and A90 respectively.

Comparing alloys in Tables II and IV that have magnetic properties giving similar performance levels in a generator; alloys CV18, CV19, and CV20 provide much higher impact energies and improved yield strength over low-chromium and high-chromium Ni-Cr-Mo-V steel alloys A80 and A90. For example, alloy CV18 test 2 and alloy CV19 test 3 have magnetic properties, when compared to the design criteria shown in FIG. 3, exceeding the design requirements of a current generator rotor. The good magnetic permeability is combined with high strengths of 123.1 and 147 ksi, and high impact energies of 145 and 148 foot-pounds for the respective samples. In Table II, magnetic properties exceeding the design requirements of a current generator are shown by alloy A80 test nos. 3 and 5, and alloy A90 test no. 3. However, tests 3 and 5 for alloy A80 and test 3 for alloy A90 exhibit lower yield strengths of 104.1, 116.8 and 99.7 ksi., and significantly lower impact energies of 80, 32 and 127 foot-pounds respectively as compared to alloys CV18 test 2 and CV19 test 3.

Stated in another way, at high yield strengths required in new generator designs, alloys CV18, CV19, and CV20 provide a much higher impact energy and improved magnetic properties over low-chromium and high-chromium Ni-Cr-Mo-V steel alloys A80 and A90.

The sample of alloy CV20 shown in Table IV was given a heat-treatment similar to the heat-treatment for alloy CV18 test 1 and alloy CV19 test 1. This heat-treatment was improved upon in later tests shown by alloy CV18 test 2 and alloy CV19 test 3, which tests resulted in a significant improvement in yield strength, impact energy, and magnetic properties. A similar improvement in the properties of CV20 are expected if it is given the heat-treatment shown for alloy CV18 test 2 and alloy CV19 test 3.

Long term heat-treatments and slow cooling rates used for the tests in Table IV were of the type a generator rotor would be subjected to in a manufacturing process. Alloys CV18, CV19, and CV20 were found to have a high impact energy as required in new generator rotors after such long term heat treatments and slow cooling, confirming that the impact energy of the alloys of this invention is not substantially impaired by temper embrittlement.

Because of the good magnetic properties, impact energy, and yield strength found in the titanium containing alloys CV12 and CV14, it is expected titanium could be substituted for niobium in alloys CV18, CV19, and CV20 to obtain similar improvements in the combination of strength, impact energy, and magnetic properties found in alloys CV18, CV19, and CV20.

We claim:

1. A low-alloy steel suitable for use in generator rotors, consisting essentially of, in weight percent;
about 4.0 to 4.5 percent nickel,
about 1.0 to 1.5 percent chromium,
about 0.3 to 0.8 percent molybdenum,
about 0.05 to 0.15 percent vanadium,
about 0.15 to 0.25 percent carbon,
about 0.03 to 0.1 percent niobium, and
the balance substantially iron, the steel having a high magnetic permeability.

2. A low-alloy steel suitable for use in generator rotors, consisting essentially of, in weight percent;
about 4.75 to 5.25 percent nickel,
about 0.75 to 1.25 percent chromium,
about 0.3 to 0.8 percent molybdenum,
about 0.05 to 0.15 percent vanadium,
about 0.1 to 0.2 percent carbon,
about 0.03 to 0.1 percent niobium, and
the balance substantially iron, the steel having a high magnetic permeability.

3. A low-alloy steel suitable for use in generator rotors, consisting essentially of, in weight percent;
about 4.0 to 4.5 percent nickel,
about 1.0 to 1.5 percent chromium,
about 0.3 to 0.8 percent molybdenum,
about 0.05 to 0.15 percent vanadium,
about 0.15 to 0.25 percent carbon,
about 0.03 to 0.1 percent titanium, and
the balance substantially iron, the steel having a high magnetic permeability.

4. A low-alloy steel suitable for use in generator rotors, consisting essentially of, in weight percent;
about 4.75 to 5.25 percent nickel,
about 0.75 to 1.25 percent chromium,
about 0.3 to 0.8 percent molybdenum,
about 0.05 to 0.15 percent vanadium,
about 0.1 to 0.2 percent carbon,
about 0.03 to 0.1 percent titanium, and
the balance substantially iron, the steel having a high magnetic permeability.

5. A generator rotor made from a low-alloy steel consisting essentially of, in weight percent;
about 4.0 to 4.5 percent nickel,
about 1.0 to 1.5 percent chromium,
about 0.3 to 0.8 percent molybdenum,
about 0.05 to 0.15 percent vanadium,
about 0.15 to 0.25 percent carbon,
about 0.03 to 0.1 percent niobium, and
the balance substantially iron, the rotor having a high magnetic permeability.

6. A generator rotor made from a low-alloy steel consisting essentially of, in weight percent;
about 4.75 to 5.25 percent nickel,
about 0.75 to 1.25 percent chromium,
about 0.3 to 0.8 percent molybdenum,
about 0.05 to 0.15 percent vanadium,
about 0.1 to 0.2 percent carbon,
about 0.03 to 0.1 percent niobium, and
the balance substantially iron, the rotor having a high magnetic permeability.

7. A generator rotor made from a low-alloy steel consisting essentially of, in weight percent;
about 4.0 to 4.5 percent nickel,
about 1.0 to 1.5 percent chromium,
about 0.3 to 0.8 percent molybdenum,
about 0.05 to 0.15 percent vanadium,
about 0.15 to 0.25 percent carbon,
about 0.03 to 0.1 percent titanium, and
the balance substantially iron, the rotor having a high magnetic permeability.

8. A generator rotor made from a low-alloy steel consisting essentially of, in weight percent;
about 4.75 to 5.25 percent nickel,
about 0.75 to 1.25 percent chromium,
about 0.3 to 0.8 percent molybdenum,
about 0.05 to 0.15 percent vanadium,
about 0.1 to 0.2 percent carbon,
about 0.03 to 0.1 percent titanium, and
the balance substantially iron, the rotor having a high magnetic permeability.

* * * * *